US005153551A

United States Patent [19]

Fournier et al.

[11] Patent Number: 5,153,551

[45] Date of Patent: Oct. 6, 1992

[54] MANUAL CONTROL DEVICE FOR A THERMAL RELAY

[75] Inventors: Bernard Fournier, Le Plessis Bouchard; Philippe Rix, Paris, both of France

[73] Assignee: Telemecanique, France

[21] Appl. No.: 718,708

[22] Filed: Jun. 21, 1991

[30] Foreign Application Priority Data

Jun. 22, 1990 [FR] France ..... 90 07822

[51] Int. Cl.[5] ..... H01H 37/00; H01H 61/00; H01H 85/00

[52] U.S. Cl. ..... 337/1; 337/37; 337/91; 200/332

[58] Field of Search ..... 337/1, 2, 3, 4, 5, 6, 337/12, 13, 37, 91, 298, 312; 335/1, 6, 23, 35; 200/342, 341, 329, 330, 331, 332, 335

[56] References Cited

U.S. PATENT DOCUMENTS 3,750,076 7/1973 Hines ..... 337/91
5,034,584 7/1991 Fanta ..... 200/332

*Primary Examiner*—Harold Broome
*Attorney, Agent, or Firm*—William A. Drucker

[57] ABSTRACT

A device for manually controlling a thermal relay associated with a contactor and housed, together with the contactor, in a case having stop and reset push-buttons, comprises levers mounted for rotation in a support fixed to the front of the box of the thermal relay. Each of the push-buttons engages a respective lever so that the latter is applied on a stop pusher or a reset pusher of the thermal relay. A combined stop and reset operation from the actuation of the stop push button alone is possible because the stop lever bears on the reset lever.

10 Claims, 3 Drawing Sheets

MANUAL CONTROL DEVICE FOR A THERMAL RELAY

BACKGROUND OF THE INVENTION

The present invention relates to a device designed for housing and manually controlling an electric relay, such as a thermal relay, associated with a contact or for protection of the latter against overloads.

It is common practice to house in cases, such as cases for electric apparatus, switches protected against overloads and formed by the association of a contact or and a thermal relay.

It will be recalled that the contractor comprises a control electromagnet and defines the ON and OFF operation of a power load, for example a motor, as a function of the current which flows through the coil of the electromagnet. The thermal relay determines the stopping of the motor, particularly in the case of an overload in at least one phase conductor of the motor ; for this, the thermal relay comprises a switch which is controlled by an opening mechanism responsive to the deflection of bimetal strips in the case of overloads and which is electrically connected in series with the coil of the electromagnet of the contractor.

The opening mechanism must be resettable after each tripping operation. Depending on the type of thermal relay considered, resetting is either manual, or automatic, or manual or automatic, by including in the latter case a manual-automatic selection means. Manual resetting is achieved by means of a push-button disposed on the front face of the thermal relay.

In addition, it is often necessary for such a thermal relay to be able to control manually the stopping of the contractor thermal relay assembly by means of another push-button, also disposed on the front face of the thermal relay and acting on the opening mechanism for opening the switch.

When the contractor-thermal relay assembly is fitted in a case, a control push-button is provided on a front wall thereof. By pressing this button an operator acts on the pushers which stop and reset the thermal relay. This stopping and resetting action is transmitted to the pushers of the thermal relay by transmission means whose purpose is to transform the movement of the control push-button into a movement of the controlled pushers, while taking into account lost motion for application on the pushers and misalignment between the push-button and the pushers of the thermal relay.

It is an object of the invention is to facilitate the mechanical transmission between the control buttons of a case housing a contractor-thermal relay assembly of the type described and the pushers actuating the thermal relay.

Another object is to conveniently conciliate both the presence of push-buttons mounted on the front face of the case with a relatively large between axis distance and the use of pushers connected to the thermal relay. and having a relatively small between axis distance.

Yet another object is to allow the user to operate either resetting of the opening mechanism of the thermal relay alone, or stopping—i.e. opening of the switch of the thermal relay—and combined resetting, using simple and compact means.

SUMMARY OF THE INVENTION

According to the invention, in a device of the type described in which the thermal relay has a stop and reset pusher or a stop pusher and a reset pusher, the transmission means comprise at least one lever having a drive surface which can be applied on a pusher of the thermal relay and a receiving surface on which the thrust element of the push-button is applied, the lever being movably mounted in a support fast with the box of the thermal relay.

In different embodiments, the transmission means will be provided with only a stop lever from a stop push-button or with a stop lever and a reset lever from respective stop and reset push-buttons. When the device comprises two push-buttons, two levers and two pushers, it is advantageous for the stop lever to be adapted for application on a part of the reset lever, for example by means of appropriate arms, so as to drive the reset pusher in response to actuation of the stop push-button; this allows the user either to reset or to combine stop and reset. The drive surface and the receiving surface of each lever are positioned so as to generate the desired transmission ratio; the stroke may thus be amplified, i.e. a stroke of the drive surface can be obtained which is amplified with respect to the stroke of the receiving surface.

The transmission lever or levers is or are for example a bar or bars mounted for pivoting in bearings of the support, preferably so as to rotate about an axis parallel to the front face of the box of the thermal relay. Each lever has a surface which cooperates with a thrust element of a push-button and which is offset along the pivoting axis with respect to the position of the corresponding pusher. When the device comprises two push-buttons, two levers and two pushers, the respective surfaces of the stop lever and of the reset lever are separated axially by a distance appreciably greater than the distance between the axes of the pushers.

There may than be a certain latitude in positioning the relatively bulky push-buttons with the desired accuracy for actuating the relatively small pushers.

The support of the transmission means is for example a cradle having lateral interlocking and/or snap-fit conformations cooperating with complementary elements on the box of the thermal relay. The cradle advantageously comprises a front strip with openings coinciding with openings provided in the front face of the box for terminals of the thermal relay, so as to leave the openings of the box free. The support may thus advantageously form at the same time a cover for protecting the terminals against touching.

Pins for connecting the switch housed in the thermal relay with the coil of the contractor may be fixed to the support, the latter being preferably pre-wired with the contractor before the thermal relay is fixed thereon so as to ensure the certainty of coherence between the electric stopping and the mechanical stopping.

BRIEF DESCRIPTION OF THE DRAWINGS

The description of one embodiment which will now be given with reference to the accompanying figures will better show the characteristics and advantages of the invention.

DESCRIPTION OF THE PREFERRED EMBODIMENT

Figure 3:
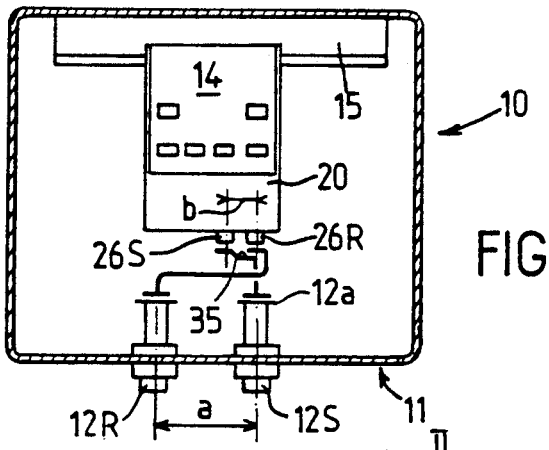
FIGS. 2 and 3 are corresponding cross sections through planes II—II and III—III.
Figure 1:
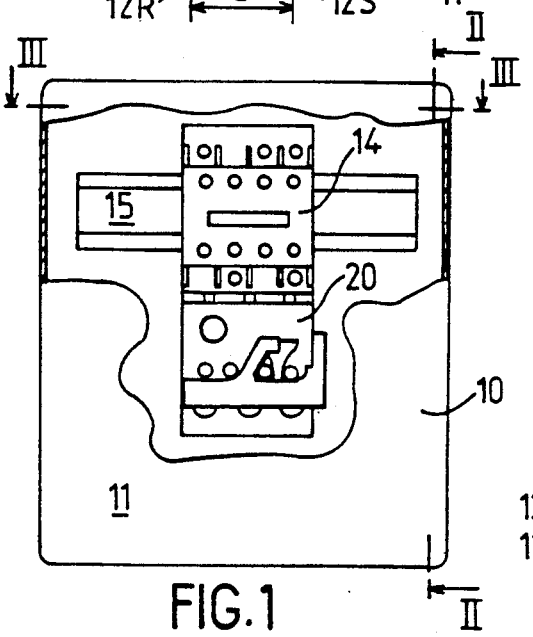
FIG. 1 is a schematic front view of a case with a thermal relay in accordance with the invention, the front wall of the case being shown with parts cut away.
Figure 2:
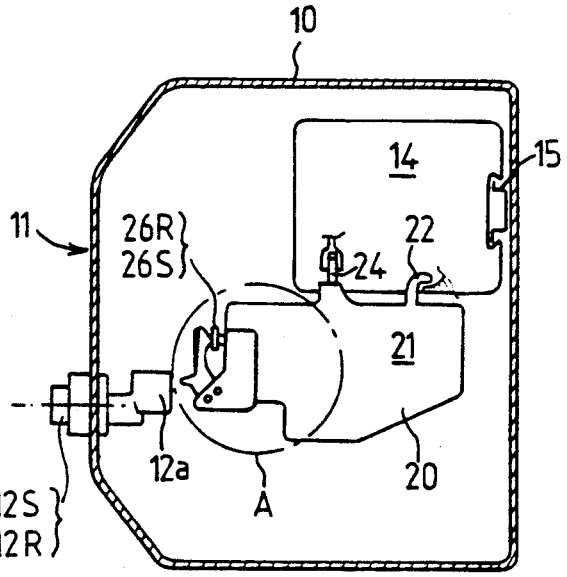
Figure 9:
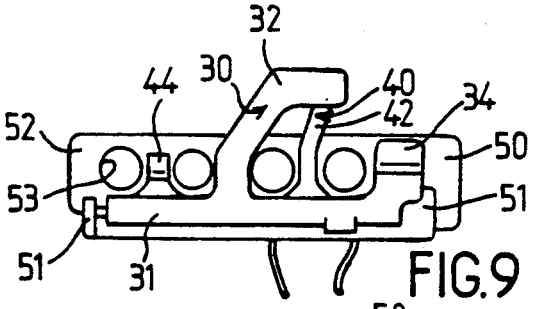
FIGS. 9 to 11 show respectively in front, back and top views one embodiment of the support for the stop and reset levers.
Figure 10:
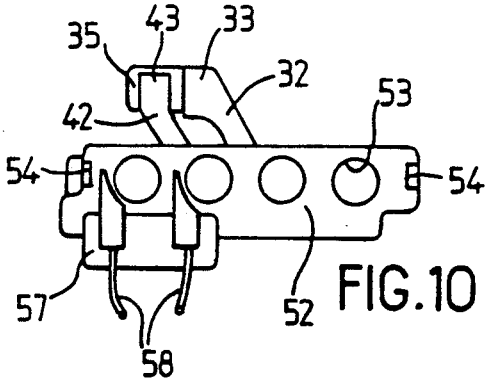
Figure 11:
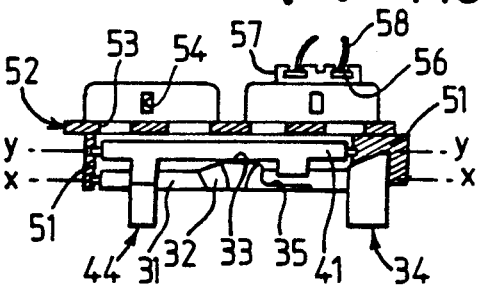

The case 10 for an electric apparatus shown in FIGS. 1 to 3 comprises a front wall 11 with two push-button namely a stop button 12S and a reset button 12R. Buttons 12R and 12S are not shown in FIG. 1 because part of wall 11 has been cut away.

The case houses more precisely a contractor 14 mounted on a rail element 15 and a thermal relay 20 which is associated electrically with the contact or so as to protect the load controlled by a contractor against overloads.

The thermal relay 20 comprises a box 21 (see figures 1 to 5) and is fixed to the contractor by fixing means 22. Box 21 comprises power terminals 23 and power connection pins 24 adapted to be connected to terminals of the contractor.

On the front face 25 of box 21, a stop pusher 26S and a reset pusher 26R are provided which are urged towards their rest position by respective springs not shown. It should be recalled that the thermal relay comprises a switch controlled by an opening mechanism sensitive to the deflection of bimetal strips in the case of an overload and is electrically connected in series with the coil of the electromagnet of the contractor. Pushers 26S, 26R act on the opening mechanism for respectively opening the switch and resetting said mechanism. With pusher 26R are associated selection means for selecting manual resetting by means of said pusher or automatic resetting.

Figure 4:
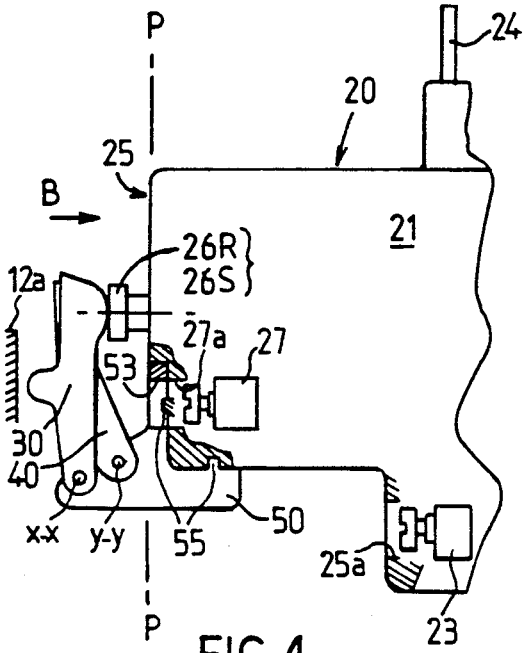
FIG. 4 shows on a larger scale the detail A of the thermal relay of FIG. 2.
Figure 5:
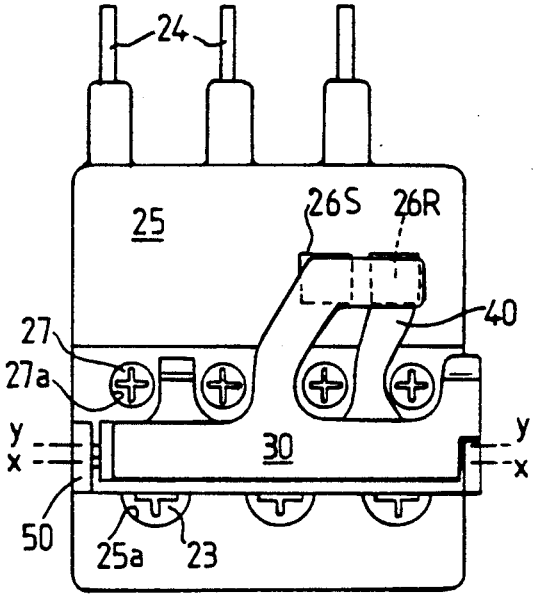
FIG. 5 is a view of the thermal relay along arrow B of FIG. 4, FIGS. 6 to 8 show the control of the thermal relay in the respective ON, resetting alone, or combined stopping and resetting operations.

Above the pushers 26S, 26R and opening on to the front face 25 openings 27*a* are provided for the screws of terminals 27 for signaling or for connecting the switch with the coil of the contractor, and on a set-back portion of the front face openings 25*a* are provided for the screws of the power terminals 23 (FIG. 4).

Each push-button 12R has a thrust element 12*a* such as a collar or similar element (see FIGS. 2 and 4) for acting on transmission means comprising a stop lever 30 and a reset lever 40, these levers being mounted for pivoting in bearings of a front support 50 fixed directly by snap-fit and/or interlocking on the box 21 of the thermal relay 20.

Figure 12:
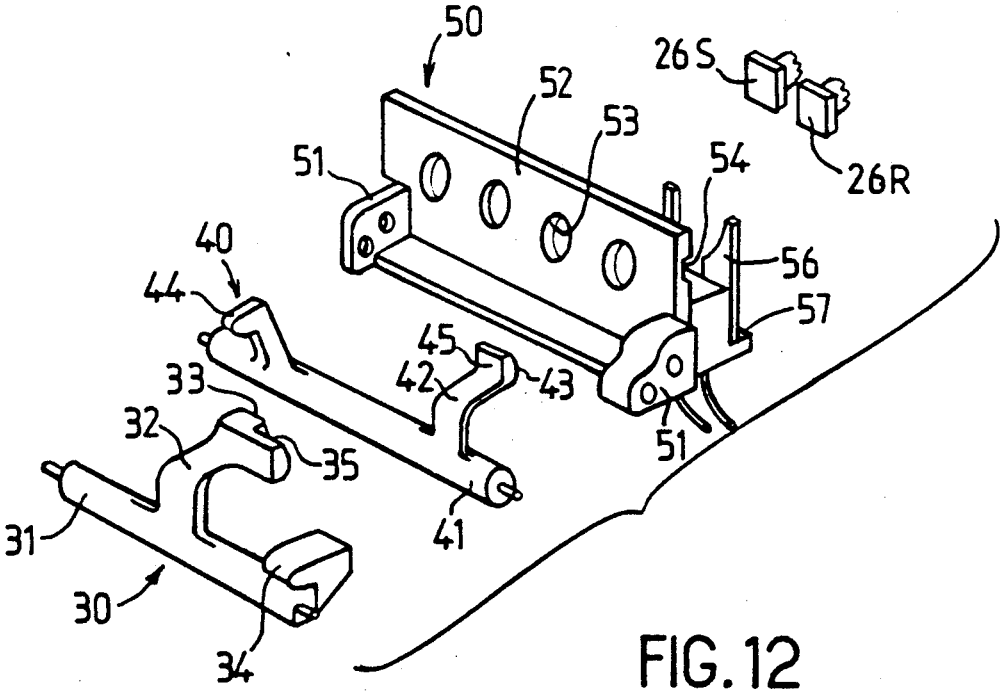
FIG. 12 is an exploded perspective view of the support of FIGS. 9 to 11.

Levers 30, 40 are mounted for pivoting about axes x—x, respectively y—y, parallel to the plane P of the front wall 25 and horizontal. The axes could possibly be merged. As can be seen in FIG. 12, each lever 30 (40) comprises a horizontal bar 31 (41) to which a perpendicular arm 32 (42) is attached. The arm 32 (42) has at one end and on the same side as the pushers a boss 33 (43) which can be applied on the corresponding pusher 26S (26R).

Lever 30 (40) further has a boss 34 (44) preferably formed as a projection on bar 31 (41) on the same side as the push-buttons. The bearing zones of bosses 33, 43 and 34, 44 are provided so as to ensure a control stroke of pushers 26 greater than that of push-buttons 12, such amplification being desirable to overcome the dispersion of the tripping strokes of the pushers. In addition, bosses 34 (44) are spaced apart by a sufficient distance for actuating, from bulky push-buttons with a distance a between axes, pushers having a small frontal area and a much smaller distance b between axes. The distance between losses 34 and 44 may for example be close to a.

Lever 30 has a drive surface 35 which can be applied on arm 42 of lever 40, for example on the back 45 of boss 43. Thus, actuation of the stop push-button 12S causes the combined movement of pushers 26R, 26S. Surface 35 is for example situated on a set-back portion of boss 33. This portion may possibly be detachable for the case where it might be desirable, in some apparatus, to actuate pusher 26R unequivocally by button 12R and pusher 26S alone by button 12S.

By the configuration of the bosses and of the levers, priority of actuation of one pusher over the other can be obtained. In particular, the reset pusher 26R may be driven in with a slight advance on the stop pusher 26S if the opening mechanism requires it. Levers 30, 40 are reset to their rest position by a specific spring or preferably by springs specific to the pushers 26. Support 50 has appropriate stops for the levers.

In the embodiment shown in FIGS. 9 to 12, the support 50 for levers 30, 40 also serves as protective cover against direct contact for terminals 27. Towards the front it comprises lugs 51 with bearings for the pivoting levers 30, 40 and a front strip 52 connecting the lugs together and having openings 53 coinciding with the openings 27*a*; thus, the fitting of support 50 at the front of the thermal relay does not adversely affect the faculty of operating the terminals thereof.

Support 50 further has interlocking and/or snap-fit elements 54 (FIGS. 12 and 13) cooperating with complementary elements 55 of box 21 of the thermal relay for holding the support in position on the box.

Two connectors 56 are fixed to a horizontal surface 57 of support 50 intended to come under box 21; these connectors 56 are intended to penetrate and be clamped in some of the terminals 27 of the thermal relay so as to provide, by means of conductors 58 connected to suitable terminals of the contractor, the desired series connection of the thermal relay switch with the coil of the contractor. It is advantageous for support 50 to be thus pre-wired with the contractor mounted in the case, the user subsequently fixing a thermal relay of the desired power to the contractor, then fixing the support on the front of the thermal relay.

Figure 7:
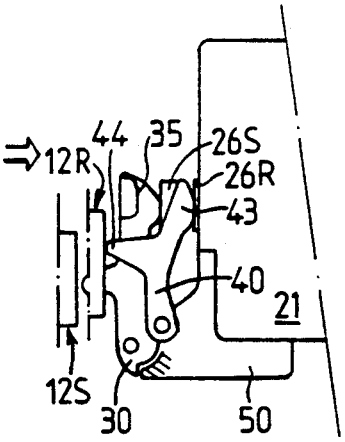
Figure 8:
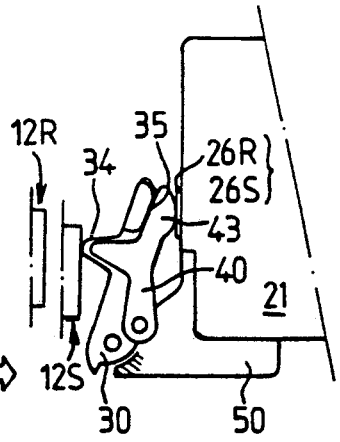

Operation of the device described will be explained with reference to FIGS. 6 to 8, assuming that the selection of the manual reset mode has been previously made.

Figure 6:
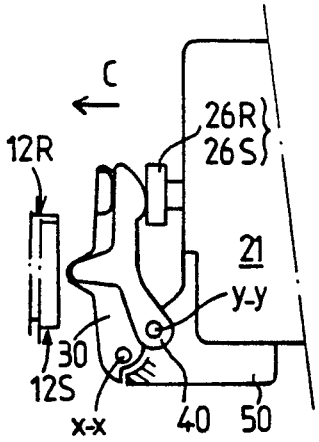

FIG. 6 shows the "ON" state of the thermal relay 20. The thrust shoulders or collars 12*a* of the control buttons 12R, 12S are held pushed out in the direction of arrow C by the return spring proper to these buttons. Levers 30, 40 are held pushed out in the direction of arrow C by the springs of pushers 26R, 26S.

When the operator desires to effect manual resetting, he presses the push-button 12R whose collar is applied on the boss 44 of the reset lever 40. Boss 43 thereof is applied on the reset pusher 26R which drives in and resets the opening mechanism of the thermal relay. During this operation, the stop pusher 26S is not operated.

When the operator desires to open the switch of the thermal relay manually, he presses the stop push-button 12S. The collar thereof is applied on boss 34 of the stop lever 30 ; the result is application of boss 33 of lever 30 on the stop pusher 26S and application of the surface 35 on the back of boss 43, so phat the latter is applied on the reset pusher 26R. The two pushers are then driven in from a single operation on the stop push-button 12S.

Figure 13:
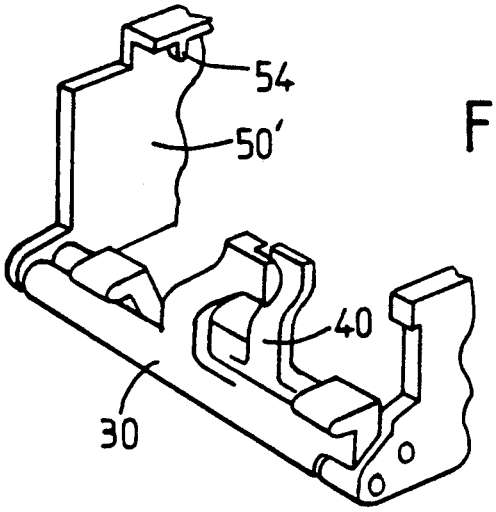
FIG. 13 shows a modified embodiment of the support in perspective.

FIG. 13 shows in perspective a support variant 50' which does not serve as a terminal cover.

The movement of levers 30, 40 in the support could take place in translation instead of in rotation. The invention also applies in the situation where the case only comprises one stop push-button 12 and the thermal relay only one stop pusher 26.

What is claimed is:

1. In an assembly comprising:

a contractor having a load control electromagnet fitted with a coil ; and a thermal relay having a box and, housed in said box, a switch electrically connected in series with said coil, and pusher controlled means including overload opening means opening said switch on the occurrence of an overload and resetting means for resetting the overload opening means after the occurrence of an overload, said box having a front face and at least one pusher outwardly projecting from said front face for controlling said pusher controlled means;

a device for housing said contractor and thermal relay and manually operating said pusher, said device comprising: a case enclosing said contractor and thermal relay, said case having a front wall; at least one push-button mounted on said front wall and provided with a thrust element ; at least one lever having a drive surface operatively coupled to said pusher and a receiving surface operatively coupled to said thrust element, and support means fast with said box, said lever being movably mounted in said support means.

2. In an assembly as claimed in claim 1, wherein said thermal relay has a stop pusher for controlling said overload opening means and a reset pusher for controlling said resetting means, said stop pusher and reset pusher both projecting outwardly from said front face and said device comprises : a stop push button and a rest push button, both mounted in said front wall and each provided with a thrust element ;

a stop lever and a reset lever, each having a drive surface and a receiving surface and each mounted in said support means, the drive surface of he stop lever being operatively coupled to the stop pusher, the receiving surface of the stop lever being operatively coupled to the thrust element of the stop push button, whereas the drive surface of he reset lever is operatively coupled to the reset pusher and the receiving surface of the reset lever is operatively coupled to the trust element of the reset push-button, the stop lever having a surface portion which engages the reset lever for moving the reset lever when the receiving surface of the stop push-button is pushed by the stop lever.

3. A device as claimed in claim 1, wherein said support means has bearing means and said lever is pivotably mounted in said bearings, about an axis parallel to said front face and the receiving surface of said lever is offset along said axis with respect to said pusher.

4. A device as claimed in claim 2, wherein said stop lever and said rest lever are pivotally mounted in said support about respective parallel axes and said stop and reset pushers are offset along said axis by a first distance, whereas the receiving surfaces of said stop lever and said reset lever are offset along said axis by a second distance which is larger than said first distance.

5. a device as claimed in claim 2, wherein the stop lever and the rest lever are each shaped as a bar having fist and second arms respectively located in first and second planes perpendicular to said bar, each of said arms having a free end, the free end of the first arm having said receiving surface and the free end of the second arm having the drive surfaces, the free end of the second arm of the stop lever further having said surface portion, whereas the free end of the second arm of the reset lever has a further receiving surface which is operatively coupled to said surface portion.

6. A device as claimed in claim 5, wherein said surface portion is detachable from said drive surface at the free end of the second arm.

7. A device as claimed in claim 1, wherein said support means is snap-fitted on said box.

8. A device as claimed in claim 1, wherein said thermal relay has connecting terminals and said lever is shaped as a protective cover for said terminals.

9. A device as claimed in claim 1, wherein pins, secured to said support means, interconnect said switch and said coil.

10. A device as claimed in claim 1, wherein the thermal relay has connecting terminals, said support means comprises a cradle having shaped parts, and a front strip having openings, whereas said box has complementary elements interlocking with said shaped parts, and said front face of the box has further openings for access of said terminals, said openings coinciding with said further openings.

* * * * *